United States Patent [19]

Bohn

[11] Patent Number: 5,056,590

[45] Date of Patent: Oct. 15, 1991

[54] PLATE HEAT EXCHANGER

[75] Inventor: John C. Bohn, Crestwood, Ky.

[73] Assignee: The Cherry-Burrell Corporation, Cedar Rapids, Iowa

[21] Appl. No.: 502,468

[22] Filed: Mar. 30, 1990

[51] Int. Cl.[5] ..... F28F 3/08

[52] U.S. Cl. ..... 165/78; 165/166; 165/167

[58] Field of Search ..... 165/78, 166, 167

[56] References Cited

U.S. PATENT DOCUMENTS

| | | | |
|---|---|---|---|
| 2,601,974 | 7/1952 | Hytte | 165/78 |
| 2,610,834 | 9/1952 | Dalzell | 165/78 |
| 2,616,671 | 11/1952 | Wakeman | 165/167 |
| 4,781,248 | 11/1988 | Pfeiffer | 165/167 |
| 4,804,040 | 2/1989 | Jan-Ove et al. | 165/78 |

FOREIGN PATENT DOCUMENTS

| | | | |
|---|---|---|---|
| 2741712 | 3/1978 | Fed. Rep. of Germany | 165/78 |
| 1298240 | 11/1972 | United Kingdom | 165/78 |

*Primary Examiner*—Allen J. Flanigan

*Attorney, Agent, or Firm*—Fitch, Even, Tabin & Flannery

[57] ABSTRACT

Heat exchanger plates for stacked flat plate heat exchangers include tapered collars for alignment of one plate relative to another in the stack. The tapered collar extends from the major surface portion of the plate and is tapered so as to have a constricted free end. The collar of one plate receive a collar of a neighboring plates as the plates of the stack are internested one in another. The collars are wedgingly engaged one in another to provide accurate alignment of the heat exchanger plates.

10 Claims, 2 Drawing Sheets

PLATE HEAT EXCHANGER

BACKGROUND OF THE INVENTION

1. Field of the Invention

The present invention pertains to heat exchangers of the flat plate type, and in particular to such heat exchangers where a plurality of heat exchange plates are clamped between massive end plates.

2. Description of the Related Art

Heat exchangers are employed in a wide variety of commercial applications. In the food industry, for example, it is important that process equipment be maintained to a high standard of cleanliness. Fluid-type heat exchangers frequently employ a labyrinth of relatively small sized channels (i.e., small compared to the path length) through which the fluid is made to travel. Walls of the heat exchanger are in thermal contact with the fluid flowing therethrough. The heat exchangers are immersed in a heat transfer medium such as the ambient atmosphere, or a forced air flow. The heat exchangers may also be placed in thermal contact with a liquid heat transfer medium, and it is important that the medium be kept out of contact with the food products flowing through the heat exchanger.

In typical food processing operations, and in a variety of other commercial applications it is important that the heat exchanger be thoroughly cleaned between production runs. To aid in such cleaning, flat plate heat exchangers have been developed where the core of the heat exchanger is assembled by stacking an array of heat exchanger plates, forming flow channels between adjacent plates. One example of a plate-type heat exchanger is given in U.S. Pat. No. 4,162,703. The heat exchanger plates are arranged in a stack, and first and second fluids are passed through the stack, for thermal transfer between the fluid flows.

In order to prevent leakage from the flow channels, or intrusion of heat transfer medium therein, the plates are pressed together with a pressure sufficient to form a seal therebetween. Frames have been provided with a pair of opposed end plates, or pressure plates which are clamped together, and which receive the stack of heat transfer plates therebetween. The pressure plates may be drawn together, for example, by a threaded shaft which is readily loosened to permit disassembly of the heat exchanger plates, for their thorough cleaning after a production run.

U.S. Pat. No. 4,813,478 issued to Jonsson, et al., on Mar. 21, 1989 discloses a heat exchanger apparatus wherein a stack of heat exchanger plates are sandwiched between a pair of relatively plates are sandwiched between a pair of relatively massive end plates. Fastening means such as a threaded shaft extending between the pressure plates compresses the stack. The heat exchanger plates have generally rectangular major surfaces, and are elongated in a vertical direction. Generally rectangular openings are formed in the upper and lower edges of the heat exchanger plates, being centrally located in those edges, midway between the lateral (vertical sides of the plates). A rectangular bar extends between the pressure plates and is received in the openings of each plate in the stack to provide an alignment for the plates in the stack.

Various heat exchangers have been constructed having a frame or outer casing for holding a heat transfer core comprised of an assembly of heat exchanger plates. Such arrangements are generally disclosed in U.S. Pat. Nos. 4,095,646, issued June 20, 1978 to Granetzke; 4,301,863 issued Nov. 24, 1981 to Bizzarro; 4,384,611 issued May 24, 1983 to Fung; 4,609,039 issued Sept. 2, 1986 to Fushiki, et al., and 4,762,171 issued Aug. 9, 1988 to Hallstrom, et al.

U.S. Pat. No. 4,090,556, issued to Almqvist, May 23, 1978 also discloses a flat plate heat exchanger with generally rectangular plates having cutouts in the upper and lower edges thereof. The cutouts include a rectangular recess for receiving a horizontal flange of an upper hanger member which is generally T-shaped in cross-section. The cutouts are formed such that plate material is disposed above the horizontal flange of the upper hanger, preventing downward displacement of the heat exchanger plate. The cutouts are also formed with a central opening suitable for receiving a lower hanger member which is generally square in cross-section. The top and bottom portions of the heat exchanger plates are mirror images of one another, with the cutouts cooperating with either the upper hanger of T-shaped cross-section or the lower hanger of square cross-section.

U.S. Pat. No. 4,660,633 discloses a plate heat exchanger having plates of two different types clamped together between massive pressure plates. It is important that a fluid-tight seal be formed between adjacent pressure plates when clamped together, and it is known to employ strip-like gaskets of resilient material between pressure plates for this purpose. In a first type of heat exchanger plate, U.S. Pat. No. 4,660,633 provides an open-top channel of generally trapezoidal cross-sectional configurtion. The open top of the channel has a smaller dimension than the base of the channel, so as to hold a gasket captive therein when received in the channel. The open top of the channel permits sealing communication between the gasket and a neighboring heat exchanger plate.

U.S. Pat. No. 4,781,248 also discloses a plate-type heat exchanger employing a resilient gasket for sealing between adjacent plates. As with the plates of U.S. Pat. No. 4,660,633 the plates of U.S. Pat. No. 4,781,248 have four circular openings, one at each corner thereof, in addition to medially located top and bottom openings for receiving a hanger bar. Conduits are passed between the circular openings of the heat exchanger plates and provide alignment for the plates in the stack, a convenient feature for those heat exchangers having conduits passing therethrough.

U.S. Pat. No. 4,592,414 also discloses a heat exchanger plate having four openings therein for fluid passage, one at each corner of the plate. Raised ribs are formed at each opening. Pairs of heat exchanger plates are bonded together such that the raised ribs extend in opposing outward directions. When placed together in a stack, the raised ribs are brought into contact with one another. As mentioned, the raised ribs are provided in pairs at each end of the heat exchanger plate. One raised rib of each pair has an outwardly protruding wall and the other raised rib of the pair has an opening formed therein. When the heat exchanger plates are stacked together, the outwardly extending wall of one plate assembly is received in the opening of an opposing plate assembly, and thus the plate assemblies are interfitted one in another. U.S. Pat. No. 4,285,397 also provides an interfitting between heat exchanger plates, and includes outwardly extending collars received in orifices of an adjacent heat exchanger plate.

U.S. Pat. No. 4,854,382, issued to Funke on Aug. 8, 1989 also discloses a plate heat exchanger with generally rectangular plates having openings at each corner thereof for passage of fluid when the plates are stacked together.

Certain advances are still being sought for heat exchangers, particularly heat exchangers which are routinely disassembled for cleaning and maintenance. It is important, especially in a production environment, that heat exchanger plates which are assembled in a stack are quickly and easily aligned one with another. In order to optimize the heat transfer capacity of a plate, only relatively small areas of the plate are provided for sealing engagement with an adjacent plate, and the heat transfer channels formed by a plate are, typically, numerous and of relatively small cross-sectional dimension. It is important therefore that the channels of one plate be accurately aligned with the channels of another plate and that the sealing surfaces of one plate be accurately aligned with the sealing surfaces of a mating plate if flow is to be confined within the resulting flow channels, as intended.

It is also desirable that the plates of a stack be self-aligning, not requiring significant attention during an assembly process. Further, it would be advantageous if adjacent plates would be self-sealing, making efficient use of the pressure typically applied to a stack of heat exchanger plates of similar size and passageway design.

SUMMARY OF THE INVENTION

It is an object according to the present invention is to provide a plate for a stacked plate heat exchanger assembly.

A further object according to the present invention is to provide a heat exchanger plate which is self-aligning with neighboring plates when stacked therewith.

A further object according to the present invention is to provide alignment means for the heat exchanger plates of a stack of plates which accurately align neighboring plates of the stack. These and other objects according to the present invention which will become apparent from studying the appended description and drawings are provided in a heat exchanger plate apparatus, comprising:

a body having opposed ends and first and second opposed major surfaces;

edge means at an end of said body defining a recess for receiving guide bar means;

passageway means i n said plate for the passage of fluid therethrough;

tapered collar means surrounding at least a part of said recess, extending outwardly from said first major surface, having a first end adjacent said first major surface and an opposed free end, said collar means inwardly tapered from said first end to said free end;

said collar means defines a passageway for receiving at least part of a collar means of another heat exchanger plate, so as to be wedgingly engaged therewith.

BRIEF DESCRIPTION OF THE DRAWINGS

In the drawings, wherein like elements are referenced alike.

DETAILED DESCRIPTION OF THE PREFERRED EMBODIMENT

Figure 2:
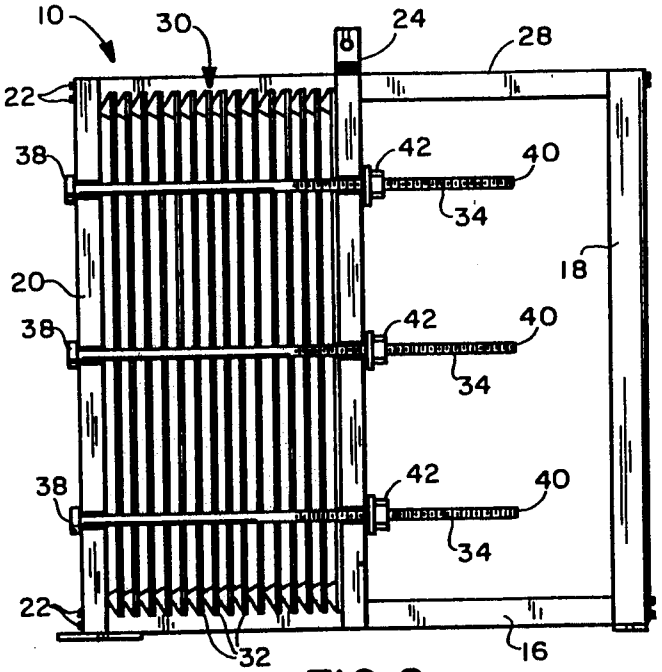
FIG. 2 is a side elevational view thereof.
Figure 3:
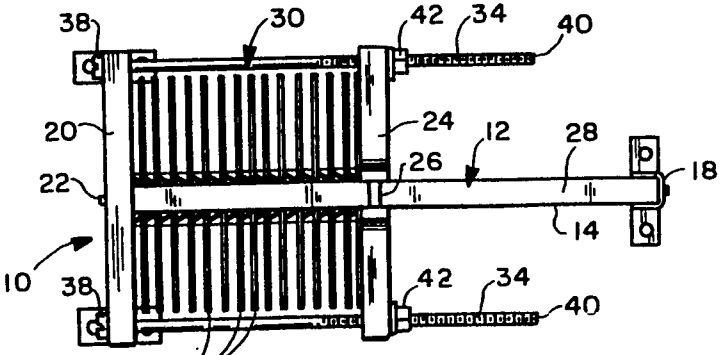
FIG. 3 is a top plan view thereof.
Figure 1:
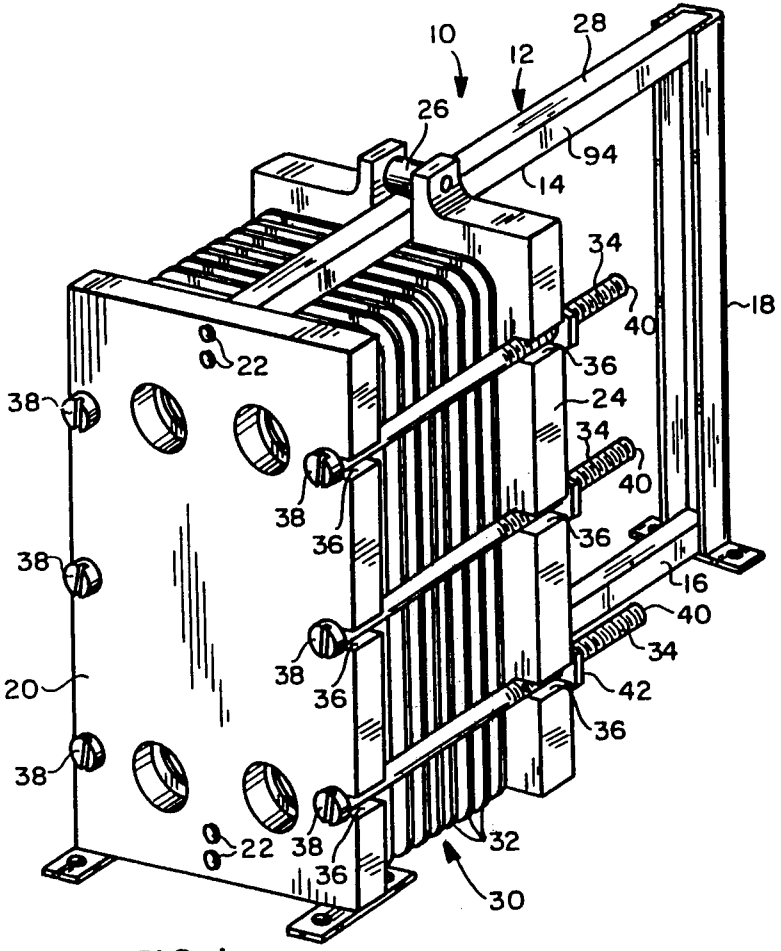
FIG. 1 is a perspective view of a heat exchanger assembly illustrating aspects according to the present invention.
Figure 9:
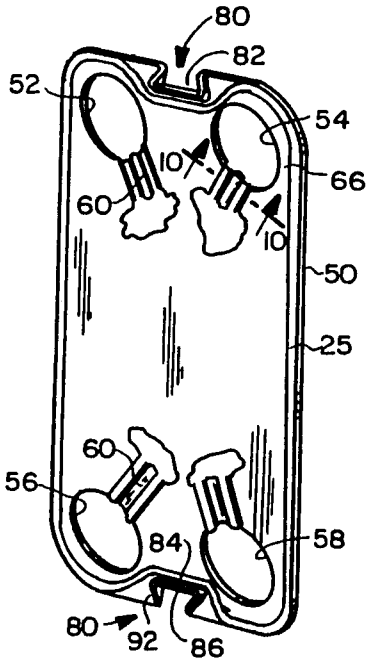
FIG. 9 is a perspective view of the plate of FIGS. 4 and 5.

Referring now to the drawings, FIG. 1 shows a flat plate heat exchanger assembly generally indicated at 10. Assembly 10 comprises an open frame generally indicated at 12, which includes upper and lower guide bars 14, 16 terminated at a rear channel support 18. Forward ends of the guide bars 14, 16 are secured to a front pressure plate 20 by screw fasteners 22. A rear pressure plate 24 is mounted for reciprocation along the upper and lower guide bars 14, 16. For example, rear pressure plate 24 includes a roller 26 at the upper end thereof for sliding across the upper surface 28 of guide bar 14.

Disposed between pressure plates 20, 24 is a stack of heat exchanger plates 30. Threaded rods 34 are received in edge recesses 36 of pressure plates 20, 24. Rods 34 have enlarged heads 38 and threaded ends 40 which receive threaded nut fasteners 42. As fasteners 42 are advanced along threaded ends 34, the pressure plates 20, 24 are drawn toward one another, thereby compressing the stack of heat exchanger plates 30. As the stack of heat exchanger plates is compressed, the front pressure plate 20 remains stationary, while the rear pressure plate 24 slides along the axis of upper guide bar 14. Thus, the heat exchanger plates also travel in this same direction, albeit slight amounts, during compression. An elastomeric gasket 25 extending along the periphery of each plate 30, prevents leakage from assembly 10. As will be seen, the alignment means of the present invention assures the gaskets of a stack of heat exchanger plates are aligned in precise order, despite the presence of the guide bars 14, 16

Referring now to FIGS. 4–11, a heat exchanger plate generally indicated at 30 will now be described. The pressure plate is preferably formed of a unitary sheet of stainless steel, other metal, or other suitable material. The heat exchanger plate includes an outer peripheral edge 50, generally rectangular in configuration, with rounded corners. The plate 30 defines apertures 52–58, one aperture at each corner thereof. A series of recesses or channel means 60 are formed in the planar sheet, to form fluid passageways for the heat transfer liquid. In the Preferred Embodiment, the channel means 60 extends from the apertures 52–58, the apertures serving as a manifold or header for the channel means of the several plates in the stack. The channel means are preferably formed between pairs of protruding walls 62 having upper surfaces 64 (see FIG. 10). Thus, the upper surfaces 64 of the channel means are raised above the planar base portion 66 of the plate. Other channel means could be employed in the practice of the present invention, including conventional constructions, such as those described in U.S. Pat. No. 4,781,248.

As the plates of the stack are pressed together, the upper surfaces 64 of a plate are pressed against the rear surface 70 of another plate. The forwardmost heat exchanger plate 30 is pressed against the rear surface of pressure plate 20, in the manner indicated in FIG. 7. The path length of the channel means in a given heat exchanger plate is quite long, but nonetheless the entire path must be maintained fluid-tight for proper operation of the heat exchanger apparatus. Also, quite importantly, the gaskets 25 located around the periphery of the heat exchanger plates must be aligned in precise order as the stack is compressed, to ensure the assembly will not leak when charged with a fluid. It is important therefore that the periphery and the interior of a plate be properly aligned with the heat exchanger plates on either side thereof.

Figure 10:
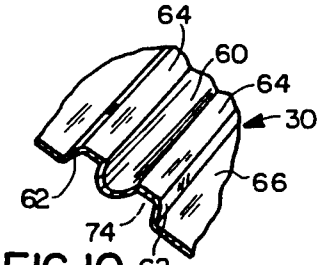
FIG. 10 is a fragmentary perspective view taken in cross-section along the line 10—10 of FIG. 9.
Figure 6:
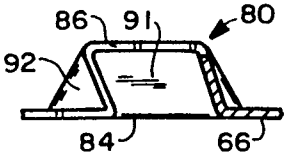
FIG. 6 is an end elevational view, taken partly in cross-section, along the line 6—6 of FIG. 5.

With regard to the plate interior, for example, the channel means illustrated in FIG. 10 could be aligned in registry with a similar channel means of a forward plate. As illustrated in FIG. 10, the walls 62 are angled toward each other at the upper ends, adjacent upper surfaces 64. Thus, a wedge-shaped cavity 74 is formed at the rear surface of the plate. The upper surface 64 would then be received in the wedge-shaped cavity 74, bringing sidewalls 62 of the plates into wedging engagement with one another to provide the desired sealing. Alternatively, the upper surfaces 64 can be positioned to contact uninterrupted portions of a forward plate, such as the flat planar portion 66. This latter arrangement is generally preferred because it is easier to separate the pressure plates upon disassembly of apparatus 10.

As can be seen from the above, it is important that the channels of one plate be accurately positioned with respect to adjacent plates placed in sealing contact therewith. It is important that the peripheral gaskets be accurately aligned as the plates are stacked together, and later compressed. As those skilled in the art will also appreciate, an optimum number of channels for a given plate size can be determined and, in practice, a relatively large number of small size channel means is usually provided. Thus, the means of locating the channel means must be highly accurate, since close tolerances are required to align the several channel means of one plate with the corresponding sealing surfaces of the neighboring plate.

According to aspects of the present invention, a tapered collar means, such as that generally indicated at 80 is located at the upper and lower ends of the heat exchanger plate to provide two dimensional alignment of the plates 30, thus assuring accurate registry of the plates as they are stacked together. The tapered collar means surrounds recesses 82, which receive the guide bars 14, 16, therein. In the Preferred Embodiment, the tapered collar means extends outwardly from the major planar surfaces 66 of the heat exchanger plate. The tapered collar means 80 has a first end 84 adjacent the major surface 66, and an opposed free end 86. According to an important aspect of the present invention, the tapered collar means is inwardly tapered from the first end 84 to the second end 86. For example, as can be seen in FIG. 7, the collar 80 extends at an oblique angle to the planar portion 66 of the plate, so that the recess 82 surrounded by the collar is constricted adjacent the collar outer free end 86.

Figure 7:
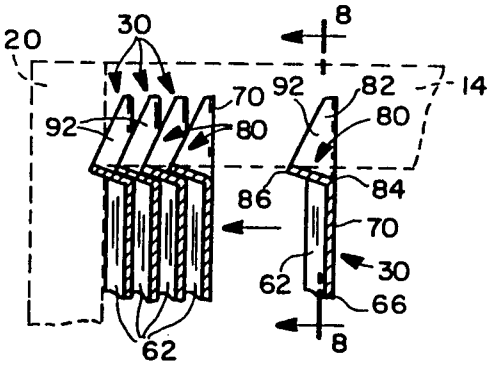
FIG. 7 is a fragmentary cross-sectional view of a plurality of heat exchanger plates stacked together.

Referring to FIG. 7, the tapered collar means of the heat exchanger plates of the stack are nested together, with a wedging engagement. The tapered collar means of a heat exchanger plate defines a passageway for receiving the tapered collar means of an adjacent heat exchanger plate, herein a rearwardly positioned plate.

The tapered collar means of FIGS. 4–11 has a generally U-shaped passageway at its free end. If desired, the intermediate or bottom portion of the tapered collar means can be located so as to press along the guide bars 14, 16 during assembly of apparatus 10. For example, the intermediate portion of the lower tapered collar means could contact the upper surface 90 of guide bar 16 (see FIG. 1). With this optional contact of the intermediate portions of the upper and lower tapered collar means, with their respective guide bars, the heat exchanger plates are constrained against movement in upward and downward directions, the vertical positioning of the several heat exchanger plates of the stack being defined by the guide bars 14, 16.

However, it is more preferred to provide some amount of "float" or clearance for the heat exchanger plates within frame 12. The tapered collar means 80 are relied upon to provide a final, accurate registration for the heat exchanger plates when stacked one behind the other. This also allows the heat exchanger plates to freely slide along the guide bars 14, 16 during assembly.

The tapered collar means 80 of the present invention includes sidewall portions 92 on either side of the collar intermediate portion 91 and joined thereto with rounded preferably part-conical corners 124. The side portions of the tapered collar means contact the side surfaces of guide bars 14, 16. In the most preferred embodiment, there is a slight clearance between the sidewalls of the upper collar means and the side surfaces 94 of upper guide bar 14 (see FIG. 1). With wedged internesting of the collar means, the heat exchanger plates are constrained against lateral movement, their longitudinal center lines being aligned along the axes of guide bars 14, 16. As can now be seen herein, the tapered collar means (preferably provided at opposite ends of the heat exchanger plates) provides a two-dimensional alignment or registration of the plates, even when placed in a fixture such as the frame 12 described above. Further, the heat exchanger plates are free to slide in the direction of the axes of guide bars 14, 16 when compressed between pressure plates 20, 24. When compressed, the plates are thereby fixed in the third dimension, and sealing engagement between the succession of plates is thus insured.

Figure 8:
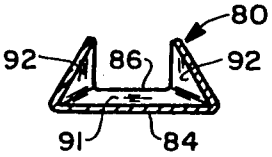
FIG. 8 is a fragmentary cross-sectional view taken along the line 8—8 of FIG. 7.
Figure 5:
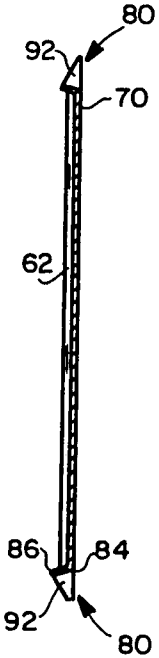
FIG. 5 is a cross-sectional view taken along the line 5—5 of FIG. 4.
Figure 4:
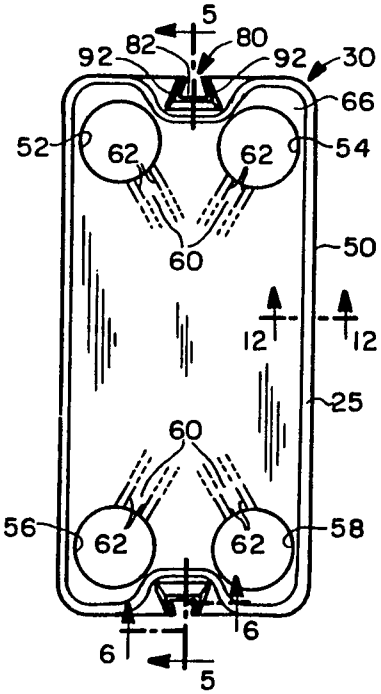
FIG. 4 is a front elevational view of a heat exchanger plate.
Figure 12:
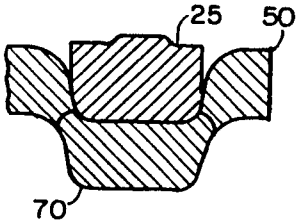
Figure 11:
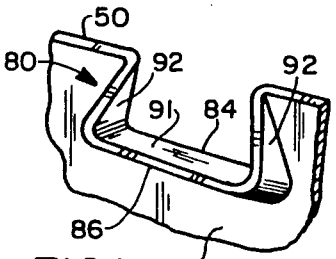
FIG. 11 is a fragmentary perspective view on an enlarged scale, showing the collar means of the preceding figures in greater detail.

As can be seen in FIG. 8, for example, the bottom wall 91 of the collar means is generally trapezoidal in configuration while the sidewalls 92 are generally triangular in configuration. The end 84 of the collar means joined to the major surface of the heat exchanger plate generally resembles a truncated triangle while the opposed free end 86 of the collar means has a U-shaped configuration. Thus, the channel means 80 has a constricted channel for receiving the guide bar, and has a free end dimensioned and configured for a close tolerance fit with multiple guide surfaces of the guide bar. The channel means 80 further has sidewalls which are tapered toward the free end so as to provide a wedging inter-engagement between nested heat exchanger plates. If desired, the bottom wall could be rectangular with a close tolerance fit provided on the sides and wedging provided in a vertical direction, although the aforedescribed two-dimensional wedging is preferred. As a further alternative, the sidewalls 92 and bottom wall 91 can be blended together to form part of a truncated cone, to provide a high degree of multidirectional wedging As can be seen from the above, a tapered collar means has been provided for the accurate alignment of internested heat exchanger plates. For example, the tapered collar means 80 provides further advantages in that a multi-sided collar is provided to lock a similar means nested therein in three dimensions, significantly contributing to the alignment and wedging engagement of internested heat exchanger plates. For example, the lower, part conical curved portions 124 extending from the bottom portion 91 cooperate with the bottom portion 91 to provide a continuous wedge construction, with the curved ends 124 of the U-shaped wedge providing rapid alignment of heat exchanger plates, while limiting the frictional forces during such alignment. If desired, however, the points of wedging engagement could be made discontinuous throughout the tapered collar means, the tapering thereof being sufficient to provide the desired highly accurate alignment between inner-nested plates.

In general, it has been found necessary only to provide an opposed pair of tapered collar means, although several pairs of opposed or even non-opposed collar means can be provided about a heat exchanger plate, if desired. For example, a plurality of tapered collar means could be provided about the periphery of a heat exchanger plate and tapered collar means could also be provided in the interior of a heat exchanger plate, if desired.

As pressure is applied to the stack of heat exchanger plates, individual plates might tend to "walk" out of alignment with neighboring plates, being dislocated in directions transverse to the major body portion of the plate. With the present invention, alignment of the plates is provided with a wedging interengagement therebetween, the wedging forces increasing as pressure on the stack of heat exchanger plates is increased and thus the present invention cooperates with a press such as that provided by the frame means and pressure plates described above to provide an improved sealing throughout the heat exchanger stack.

The drawings and the foregoing descriptions are not intended to represent the only forms of the invention in regard to the details of its construction and manner of operation. Changes in form and in the proportion of parts, as well as the substitution of equivalents, are contemplated as circumstances may suggest or render expedient; and although specific terms have been employed, they are intended in a generic and descriptive sense only and not for the purposes of limitation, the scope of the invention being delineated by the following claims.

What is claimed is:

1. A heat exchanger plate apparatus, comprising:

a body having opposed ends and first and second opposed major surfaces;

edge means at an end of said body defining a recess for receiving guide bar means, said edge means and including a bottom portion intermediate a pair of opposed side portions;

passageway means in said plate for the passage of fluid therethrough;

tapered collar means surrounding at least a part of said recess, extending outwardly from said first major surface, having a first end adjacent said first major surface and an opposed free end, said collar means tapered inwardly toward said recess from said first end to said free end; and said collar means defines a passageway for receiving at least part of a collar means of another heat exchanger plate, so as to be wedgingly engaged therewith.

2. A heat exchanger plate apparatus, comprising:

a body having opposed ends and first and second opposed major surfaces;

edge means at an end of said body defining a recess for receiving guide bar means;

passageway means in said plate for the passage of fluid therethrough, said passageway means comprising open channels in said body opening toward a similar adjacent plate apparatus and forming a fluid-tight seal therewith when the tapered collar means of the plate apparatus is wedgingly engaged with the adjacent plate apparatus;

tapered collar means surrounding at least a part of said recess, extending outwardly from said first major surface, having a first end adjacent said first major surface and an opposed free end, said collar means tapered inwardly toward said recess from said first end to said free end thereof; and said collar means defines a passageway for receiving at least part of a collar means of another heat exchanger plate, so as to be wedgingly engaged therewith.

3. The apparatus of claim I wherein said bottom portion has a generally trapezoidal configuration.

4. The apparatus of claim 2 wherein said edge means includes generally triangular side portions.

5. The apparatus of claim 4 wherein said side portions have converging free ends.

6. The apparatus of claim 4 wherein said side portions extend at generally right angles to the body.

7. The apparatus of claim 2 wherein said edge means includes side portions which have generally shaped ends adjacent said first major body surface.

8. The apparatus of claim 7 wherein the side portions terminate adjacent a peripheral edge of said body.

9. The apparatus of claim 7 wherein the side portions terminate remote from a peripheral edge of said body.

10. A heat exchanger plate apparatus, comprising:

a body having opposed ends and first and second opposed major surfaces;

edge means at an end of said body defining a recess for receiving guide bar means;

passageway means in said plate for the passage of fluid therethrough;

tapered channel means surrounding said recess, extending outwardly from said first major surface, having a first cross-sectional size thereat, a free end of reduced size remote from said first major surface, a tapered outer alignment surface and an inner camming surface for wedgingly engaging the alignment surface of an adjacent plate entering the channel means through said recess.

* * * * *

UNITED STATES PATENT AND TRADEMARK OFFICE

CERTIFICATE OF CORRECTION

PATENT NO. : 5,056,590

DATED : October 15, 1991

INVENTOR(S) : John C. Bohn

It is certified that error appears in the above-identified patent and that said Letters Patent is hereby corrected as shown below:

In Column 1, line 52, delete the entire line "wiched between a pair of relatively plates are sand-".

In Column 2, line 33, change the word "configurtion" to read --configuration--.

In Column 3, line 52, change "i n" to read --in--.

In Column 3, line 60, after "end;" insert --and--.

In Column 4, line 21, change "enlarqed" to read --enlarged--.

In Column 4, line 55, after the numerals "14, 16" insert a period --.--.

In Column 8, line 37 (Claim 3), change "claim I" to read --claim 1--.

In Column 8, line 46 (Claim 7), change "shaped" to read --S-shaped--.

Signed and Sealed this

Twenty-third Day of March, 1993

*Attest:*

*Attesting Officer*

STEPHEN G. KUNIN

*Acting Commissioner of Patents and Trademarks*